US006604913B2

(12) United States Patent
Koyama et al.

(10) Patent No.: US 6,604,913 B2
(45) Date of Patent: Aug. 12, 2003

(54) VANE PUMP

(75) Inventors: Kazuhiko Koyama, Tochigi (JP); Katsuya Arakawa, Tochigi (JP); Isamu Kikuchi, Tochigi (JP)

(73) Assignee: Showa Corporation (JP)

( * ) Notice: Subject to any disclaimer, the term of this patent is extended or adjusted under 35 U.S.C. 154(b) by 0 days.

(21) Appl. No.: 09/873,852

(22) Filed: Jun. 4, 2001

(65) Prior Publication Data

US 2002/0004013 A1 Jan. 10, 2002

(30) Foreign Application Priority Data

Jun. 30, 2000 (JP) ..... 2000-199874

(51) Int. Cl.[7] ..... F04B 49/00
(52) U.S. Cl. ..... 417/310; 417/213; 417/300
(58) Field of Search ..... 417/310, 282, 417/299, 300, 304, 307, 213; 418/180, 181, 268, 269

(56) References Cited

U.S. PATENT DOCUMENTS 4,199,304 A 4/1980 Strikis ..... 417/310
4,251,192 A 2/1981 Clark ..... 417/291
4,373,871 A * 2/1983 Christ ..... 417/310
4,597,718 A * 7/1986 Nakano et al. ..... 417/300
5,201,878 A 4/1993 Abe et al. ..... 418/133
5,289,681 A 3/1994 Iwata ..... 60/428
5,496,152 A * 3/1996 Heise et al. ..... 417/87
5,496,155 A 3/1996 Noah ..... 417/310
5,562,432 A * 10/1996 Semba et al. ..... 418/26
5,782,615 A 7/1998 Noah ..... 417/310
6,079,955 A * 6/2000 Miyazawa et al. ..... 417/213
6,267,566 B1 * 7/2001 Konishi et al. ..... 417/310
6,468,044 B1 * 10/2002 Bishop et al. ..... 417/220

OTHER PUBLICATIONS

Publication No. 09088847 Patent Abstract of Japan, vol. 1997, No. 07.
Publication No. 08226388 Patent Abstract of Japan, vol. 1997, No. 01.
Publication No. 07279871 Patent Abstract of Japan, vol. 1996, No. 02.

* cited by examiner

*Primary Examiner*—Charles G. Freay
*Assistant Examiner*—Han Lieh Liu
(74) *Attorney, Agent, or Firm*—Orum & Roth

(57) ABSTRACT

In a vane pump, a bottom surface of a suction side low pressure passage is set to be below a bottom surface of a return passage of a flow control valve in a cross portion between the return passage and the low pressure passage.

14 Claims, 4 Drawing Sheets

VANE PUMP

BACKGROUND OF THE INVENTION

1. Field of the Invention

The present invention relates to a vane pump used for a power steering apparatus or the like of a motor vehicle.

2. Description of the Related Art

As a vane pump for assisting steering force in a power steering apparatus of a motor vehicle, there is a structure having a rotor which is fixed to a pump shaft inserted to a pump casing so as to be rotated, and moves a multiplicity of vanes in a radial direction within a pump chamber to pressurize a working fluid sucked into the pump chamber so as to discharge, and having a flow control valve which returns a surplus working fluid in a discharge side high pressure passage communicated with the pump chamber to a suction side low pressure passage communicated with the pump chamber. In this vane pump, it is possible to control discharge amount of the working fluid discharged to a power cylinder side of the power steering apparatus to a fixed amount due to an existence of the flow control valve.

In the conventional art, in a crossing portion between a return passage of the flow control valve and a suction side low pressure passage provided in the pump casing, the bottom surface of the low pressure passage is set to be shallow and above a bottom surface of the return passage. Then, in this setting, particularly at a time of high pressure relief, a vibrating phenomenon is generated in which the flow control valve is hit by an inner surface of a receiving hole within the receiving hole provided in the pump casing, whereby an abrasion of the flow control valve is promoted and a service life is reduced.

SUMMARY OF THE INVENTION

An object of the present invention is to prevent a vibrating phenomenon in which a flow control valve is hit by an inner surface of a receiving hole provided in a pump casing within the receiving hole, in a vane pump.

In accordance with the present invention, there is provided a vane pump comprising:

a rotor fixed to a pump shaft inserted to a pump casing so as to be rotated, moving a multiplicity of vanes in a radial direction within a pump chamber, and pressurizing a working fluid sucked into the pump chamber so as to discharge; and a flow amount control valve returning a surplus working fluid in a discharge side high pressure passage communicated with the pump chamber to a suction side low pressure communicated with the pump chamber, wherein in a crossing portion between a return passage of the flow amount control valve and a suction side low pressure passage, a bottom surface of the low pressure passage is set to be below a bottom surface of the return passage.

BRIEF DESCRIPTION OF THE DRAWINGS

The present invention will be more fully understood from the detailed description given below and from the accompanying drawings which should not be taken to be a limitation on the invention, but are for explanation and understanding only.

The drawings

DESCRIPTION OF THE PREFERRED EMBODIMENTS

Figure 1:
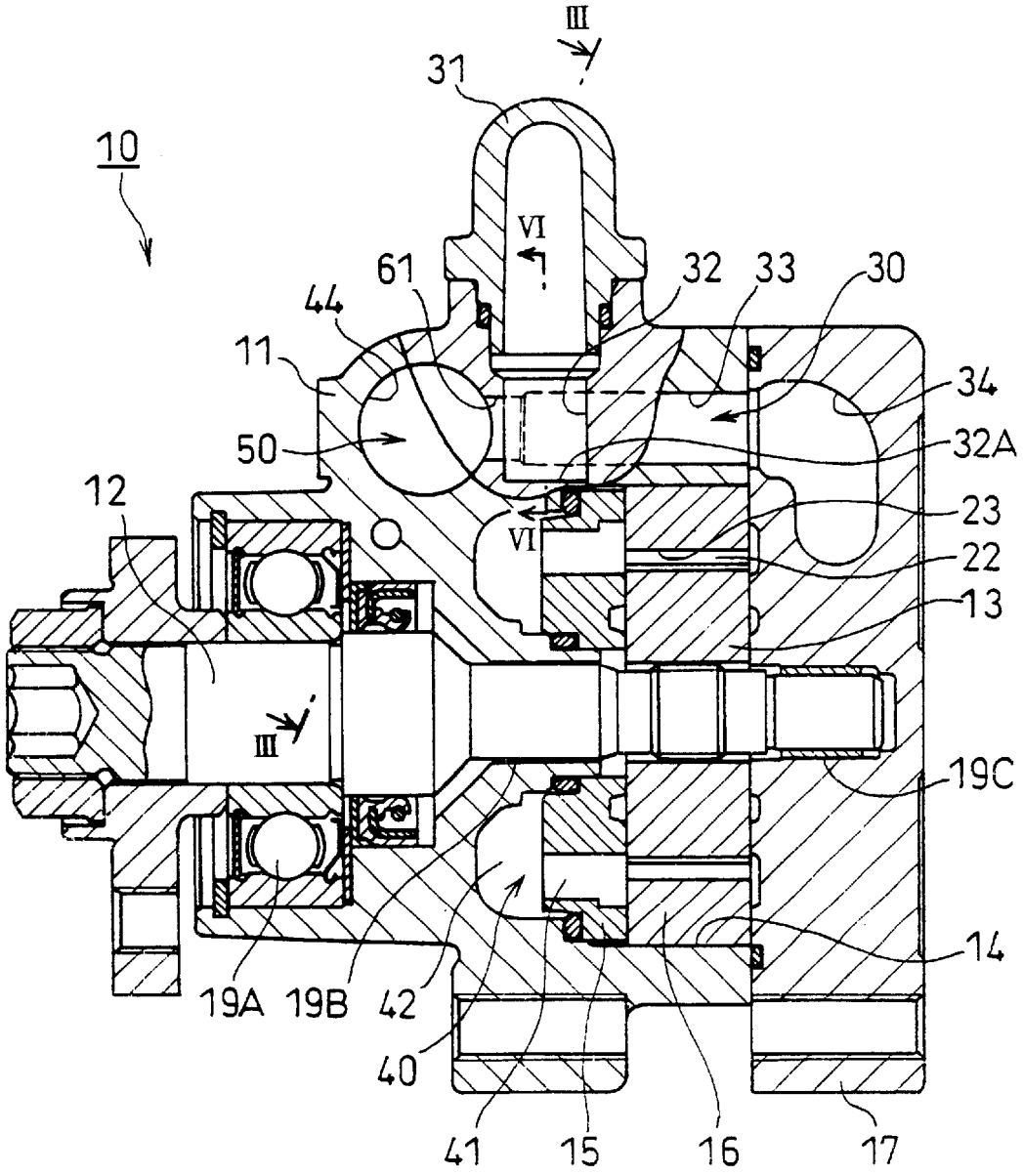
FIG. 1 is a cross sectional view showing a vane pump.
Figure 2:
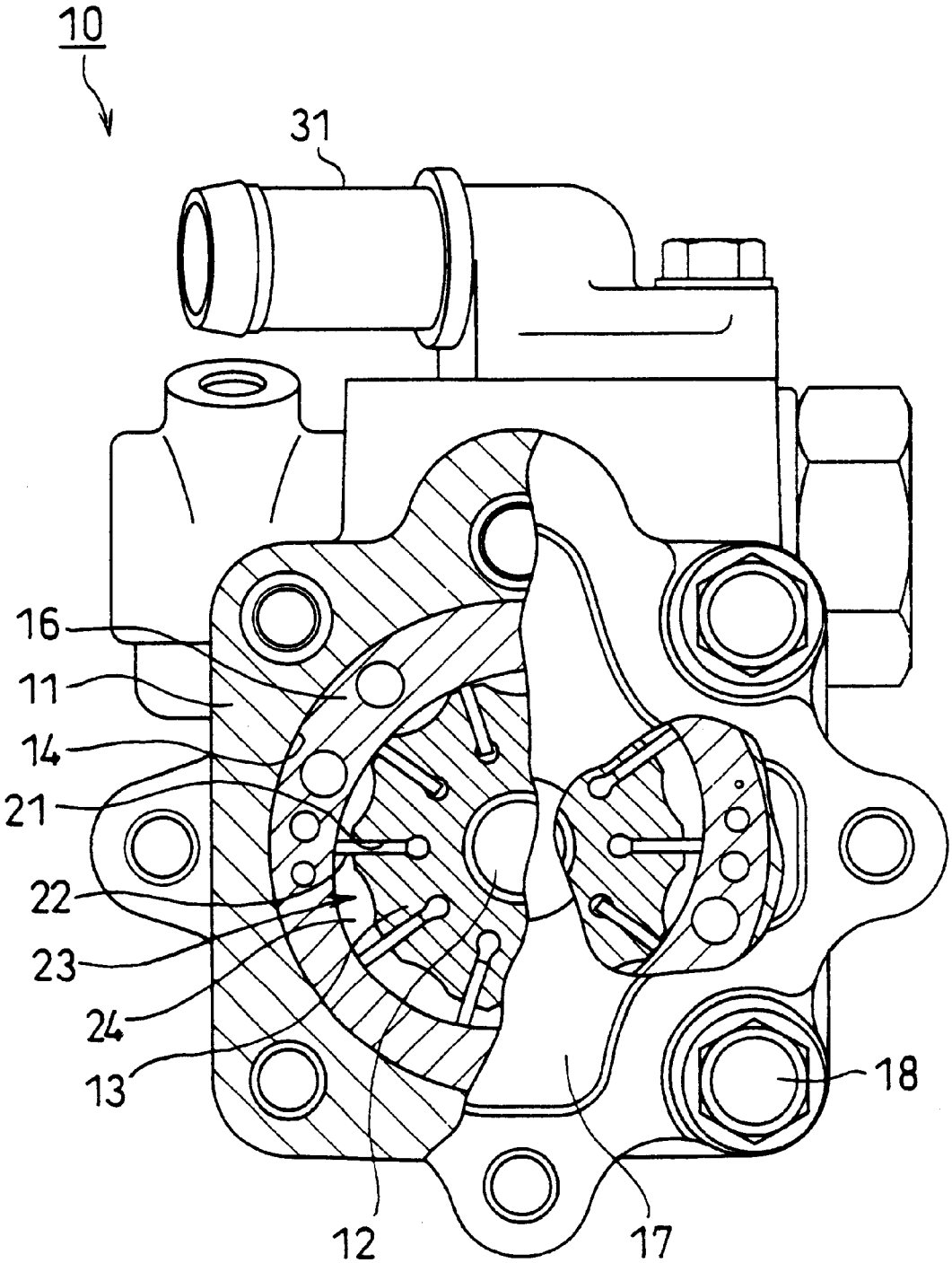
FIG. 2 is a side elevational view showing a part of FIG. 1 in a broken manner.

A vane pump 10 is used as a hydraulic pressure generating source in a hydraulic power steering apparatus of a motor vehicle. As shown in FIGS. 1 and 2, it has a rotor 13 fixed to a pump shaft 12 inserted to a pump casing 11 so as to be rotated. The pump casing 11 is provided with a recess-like receiving portion 14 open to one end, and is structured such that a side plate 15 and a cam ring 16 are received and arranged within the recess-like receiving portion 14, and the rotor 13 mentioned above is received in an inner portion of the cam ring 16. Further, a cover plate 17 which completely closes the recess-like receiving portion 14 is fixed to one end surface of the pump casing 11 by bolts 18. The pump shaft 12 is supported to each of the pump casing 11 and the cover plate 17 via bearings 19A to 19C.

The rotor 13 receives vanes 22 in grooves 21 provided at a multiplicity of positions in a peripheral direction, thereby capable of moving each of the vanes 22 in a radial direction along the groove 21. A front end of each of the vanes 22 is in slidable contact with an inner surface of the cam ring 16 mentioned above forming a pump chamber 23 so as to form a working chamber 24 between the adjacent vanes 22.

A suction hole 32 sucking a working fluid from a reservoir tank (not shown) via a suction pipe 31 and a suction passage 33 connected to the suction hole 32 are punched in the pump casing 11. Further, a sucking passage 34 communicated with the suction passage 33 of the pump casing 11 and a branch passage (not shown) branched from the sucking passage 34 are punched in the cover plate 17. A sucking port at a terminal end of the branch passage is open to a position facing to a sucking section sucking the working fluid among the working chamber 24 within the pump chamber 23. The suction hole 32, the suction passage 33, the sucking passage 34, the branch passage and the sucking port constitute a suction side low pressure passage 30.

In the side plate 15, a discharge port 41 is formed at a position facing a discharge section pressurizing the working fluid so as to discharge among the working chamber 24 which each of the vanes 22 forms in the inner portion of the pump chamber 23, and the entire working fluid discharged through the discharge port 41 is discharged to a high pressure chamber 42 between the recess-like receiving portion 14 of the pump casing 11 and the side plate 15. A high pressure working fluid discharged to the high pressure chamber 42 passes from the discharge passage 43 formed in the pump casing 11 via a receiving hole 44 for a flow amount control valve 50 formed in the pump casing 11, then is discharged to a power cylinder side of the power steering apparatus from a discharge hole 45A of a discharge joint 45. The discharge port 41, the high pressure chamber 42, the discharge passage 43 and the discharge hole 45A constitute a discharge side high pressure passage 40.

The flow control valve 50 returns a surplus working fluid in the high pressure passage 40 to the suction hole 32 in the suction side low pressure passage 30 from a return passage 61 provided in the pump casing 11 when a surplus is generated in the discharge flow amount from the discharge side high pressure passage 40 due to the reason that a right or left turning static turn steering state of a steering operation by the power steering apparatus is kept or the like, thereby controlling a discharge amount of the working fluid discharged from the discharge hole 45A of the high pressure passage 40 to be always constant.

Figure 3:
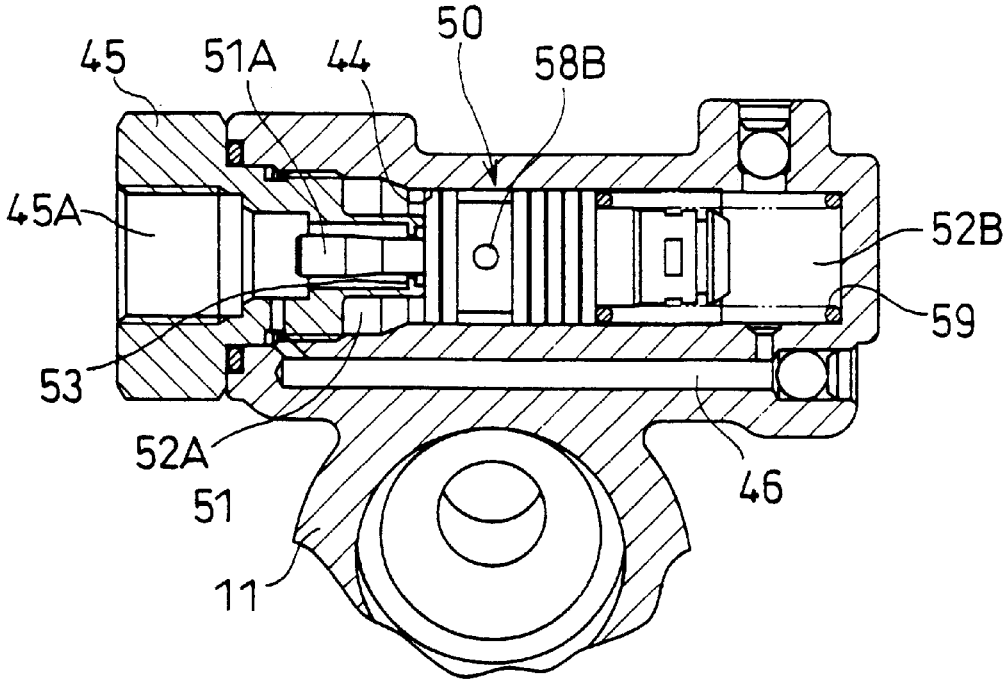
FIG. 3 is a cross sectional view along a line III—III in FIG. 1.
Figure 4:
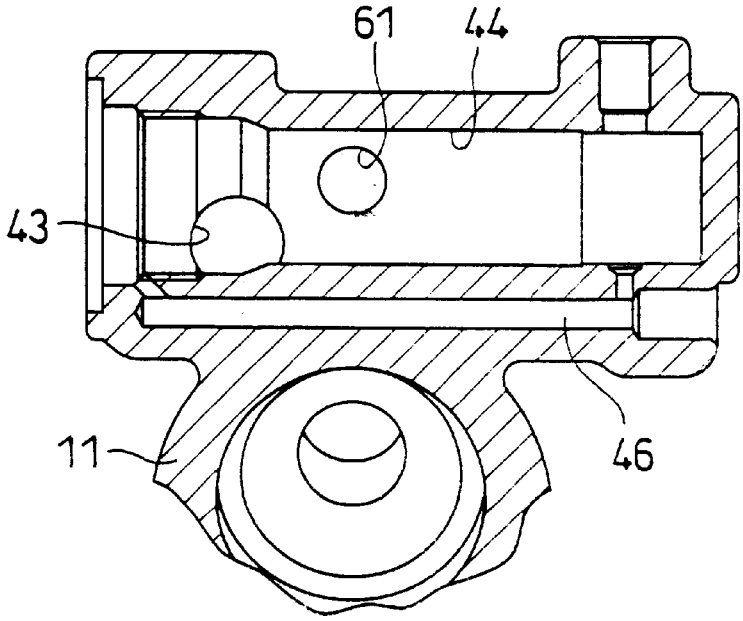
FIG. 4 is a cross sectional view showing a receiving hole of a flow control valve provided in a pump casing.
Figure 5:
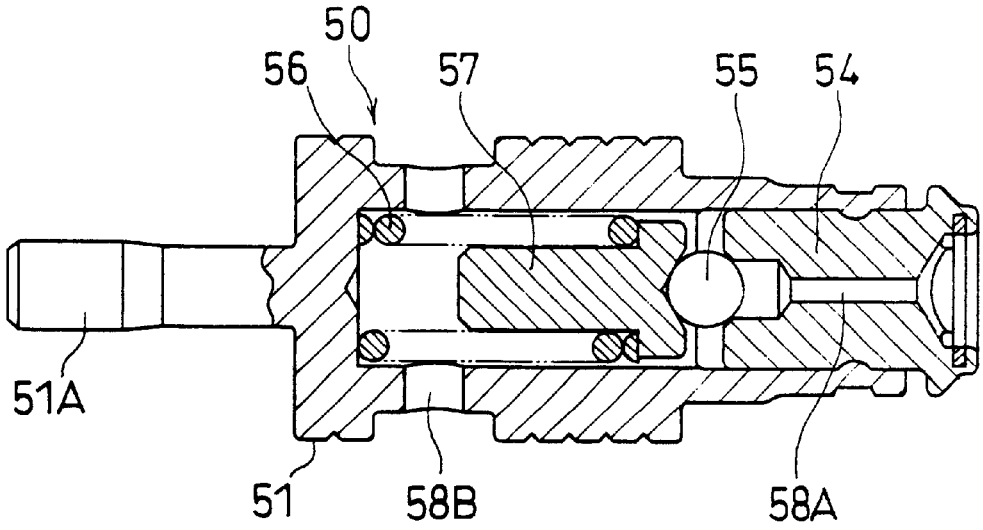
FIG. 5 is a cross sectional view showing a flow control valve.

In particular, the flow control valve 50 has, as shown in FIGS. 3 to 5, a main valve 51 slidably provided in the receiving hole 44 of the pump casing 11, thereby capable of opening and closing a communicating state between the return passage 61 of the pump casing 11 and the discharge passage 43 of the pump casing 11. In a state of normal use, the main valve 51 is urged by a spring 59 to a position at which the return passage 61 is not communicated with the discharge passage 43.

At this time, the flow control valve 50 respectively sets a side of the discharge passage 43 of the main valve 51 and an opposite side of the discharge passage 43 of the main valve 51 to a pressurizing chamber 52A and a back pressure chamber 52B storing the spring 59 mentioned above, in the inner portion of the receiving hole 44, and forms a throttle 53 held between an annular protruding portion of the discharge joint 45 and a protruding rod 51A of the main valve 51 between the pressurizing chamber 52A and the discharge hole 45A, and a fluid pressure after passing through the throttle 53 is introduced to the back pressure chamber 52B by the discharge hole 45A and a communicating passage 46 provided in the pump casing 11.

The main valve 51 has a valve seat 54 adhered to a side of the back pressure chamber 52B, a relief ball 55 opening and closing a relief passage 58A provided in the valve seat 54, a relief spring 56 urging the relief ball 55 to a closed side of the relief passage 58A, and a spring guide 57 interposed between the relief spring 56 and the relief ball 55, and is provided with a relief passage 58B for introducing a fluid entering from the back pressure chamber 52B when the relief ball 55 opens the relief passage 58A to a return passage 61 of the pump casing 11.

Accordingly, in the flow control valve 50, when fluid pressure within the vane pump 10 becomes too large, and fluid pressure in the back pressure chamber 52B reaches a relief set pressure, the fluid pressure in the back pressure chamber 52B opens the relief ball 55 against the spring 56, thereby relieving the fluid pressure in the back pressure chamber 52B from the relief passages 58A and 58B to the return passage 61 of the pump casing 11, and opens the main valve 51 against the spring 59 due to the fluid pressure in the pressurizing chamber 52A under a pressure reduction state of the fluid pressure in the back pressure chamber 52B due to the relief, as a result communicating the return passage 61 with the discharge passage 43 so as to return the surplus working fluid in the discharge side high pressure passage 40 from the return passage 61 to the suction hole 32 in the suction side low pressure passage 30.

Accordingly, in the vane pump 10, when rotating the rotor 13, the working fluid in the reservoir tank is sucked into the pump chamber 23 from the suction side low pressure passage 30 so as to be pressurized, and the pressurized working fluid is discharged from the discharge side high pressure passage 40 and controlled by the flow control valve 50 to be a fixed discharge flow amount during the process, so that a fixed amount of working fluid is discharged from the discharge hole 45A, and the surplus working fluid is returned to the suction side low pressure passage 30 from the flow amount control valve 50 via the return passage 61.

Figure 6:
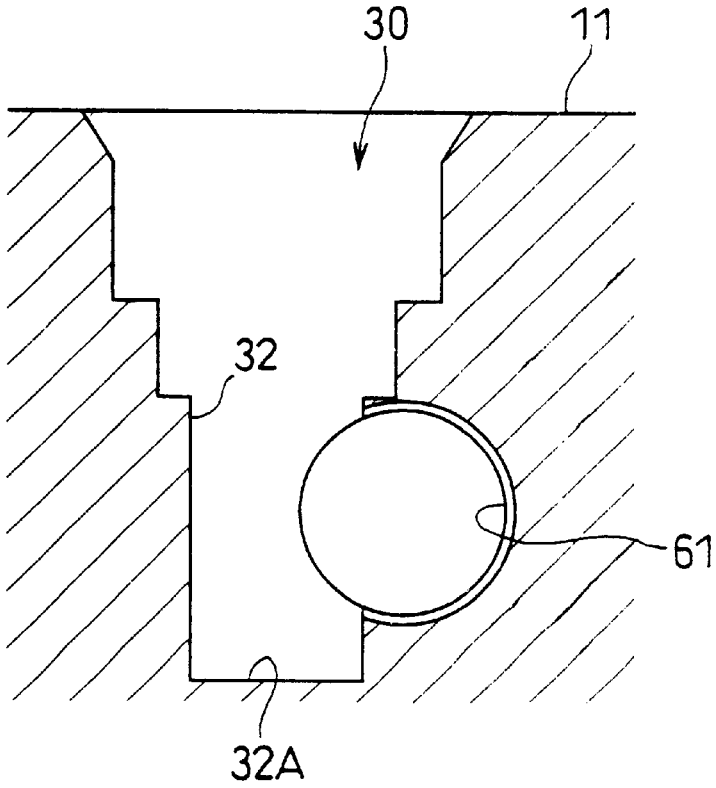
FIG. 6 is a cross sectional view showing a suction hole and a return passage provided in a pump casing along a line VI—VI in FIG. 1.

Therefore, in accordance with the present embodiment, in order to prevent a vibrating phenomenon in which the flow control valve 50 is hit by the inner surface of the receiving hole 44 provided in the pump casing 11 within the receiving hole 44 from being generated, the following structures are provided. That is, as shown in FIGS. 1 and 6, in a crossing portion between the return passage 61 of the flow control valve 50 and the suction hole 32 constituting the suction side low pressure passage 30, a bottom surface 32A of the suction hole 32 is formed in a flat surface and the bottom surface 32A of the suction hole 32 is set to be deeper than and below a bottom surface of the return passage 61.

Therefore, in accordance with the present embodiment, the following effects can be obtained.

(1) In the crossing portion between the return passage 61 of the flow control valve 50 and the suction side low pressure passage 30, provided in the pump casing 11, the bottom surface of the low pressure passage 30 is set to be deeper than and below the bottom surface of the return passage 61. In accordance with the experiments of the inventor of the present invention, it is possible to prevent a vibrating phenomenon in which the flow control valve 50 is hit by the inner surface of the receiving hole 44 provided in the pump casing 11 in the inner portion of the receiving hole 44 from being generated even at a time of high pressure relief, whereby it is possible to prevent the flow control valve 50 from being abraded.

(2) In the case that the intake side low pressure passage 30 crossing to the return passage 61 of the flow control valve 50 is set to the suction hole 32 communicated with the reservoir tank via the suction pipe 31, and the bottom surface 32A of the suction hole 32 is below the bottom surface of the return passage 61 and formed in a flat surface, the generation of the vibrating phenomenon mentioned in the above item (1) can be more securely prevented.

As heretofore explained, embodiments of the present invention have been described in detail with reference to the drawings. However, the specific configurations of the present invention are not limited to the embodiments but those having a modification of the design within the range of the present invention are also included in the present invention.

As mentioned above, in accordance with the present invention, in the vane pump, it is possible to prevent the vibrating phenomenon in which the flow control valve is hit by the inner surface of the receiving hole provided in the pump casing within the receiving hole from being generated.

Although the invention has been illustrated and described with respect to several exemplary embodiments thereof, it should be understood by those skilled in the art that the foregoing and various other changes, omissions and additions may be made to the present invention without departing from the spirit and scope thereof. Therefore, the present invention should not be understood as limited to the specific embodiment set out above, but should be understood to include all possible embodiments which can be embodied within a scope encompassed and equivalents thereof with respect to the features set out in the appended claims.

What is claimed is:

1. A vane pump comprising:

a rotor fixed to a pump shaft inserted into a pump casing so as to be rotated;

a multiplicity of vanes within a pump chamber;

wherein said rotor moves said vanes in a radial direction within the pump chamber and pressurizes a working fluid sucked into the pump chamber so as to discharge;

a flow control valve having a return passage with a crossing portion;

a discharge side high pressure passage communicated with the pump chamber;

a suction side low pressure passage communicated with the pump chamber;

said low pressure passage having a flat bottom surface;

wherein said flow control valve returns a surplus of working fluid in the discharge side high pressure passage to the suction side low pressure passage;

said low pressure passage is in communication with said return passage; and the flat bottom surface of said low pressure passage is lower than a bottom surface of said return passage.

2. A vane pump as claimed in claim 1, wherein said suction side low pressure passage has a suction well, said suction well comprising a flat bottom surface formed in a flat surface and a side wall; said suction well punched in the pump casing and said suction well sucks the working fluid from a reservoir tank via a suction pipe;

said return passage punched in the pump casing, said return passage is crossed to the suction well;

the crossing portion is in communication with the side wall of the suction well; and the bottom surface of the suction well is lower than the bottom surface of said crossing portion.

3. A vane pump as claimed in claim 1, wherein said suction side low pressure passage has a suction well;

said suction well is in communication with said return passage;

and said surplus working fluid is returned to said suction well.

4. A vane pump as claimed in claim 3, wherein said suction well is punched in the pump casing and said suction well sucks the working fluid from a reservoir tank via a suction pipe.

5. A vane pump as claimed in claim 3, wherein said suction side low pressure passage has a suction passage connected to said suction well;

a sucking passage communicated with said suction passage;

and a sucking port; said sucking port in communication with said pump chamber.

6. A vane pump as claimed in claim 5, wherein said suction well is punched in the pump casing and said suction well sucks the working fluid from a reservoir tank via a suction pipe.

7. A vane pump as claimed in claim 1, wherein said return passage is punched in the pump casing.

8. The vane pump of claim 1, wherein said surplus working fluid is unpressurized when it is returned to the suction side low pressure passage.

9. A vane pump comprising:

a rotor fixed to a pump shaft inserted into a pump casing so as to be rotated;

a multiplicity of vanes within a pump chamber;

wherein said rotor moves said vanes in a radial direction within the pump chamber and pressurizes a working fluid sucked into the pump chamber so as to discharge;

a flow control valve having a return passage with a crossing portion;

a discharge side high pressure passage communicated with the pump chamber;

a suction side low pressure passage communicated with the pump chamber;

wherein said flow control valve returns a surplus of working fluid in the discharge side high pressure passage to the suction side low pressure passage;

said suction side low pressure passage has a suction well;

said suction well comprising a flat bottom surface formed in a flat surface and a side wall;

said suction well punched in the pump casing and said suction well sucks the working fluid from a reservoir tank via a suction pipe;

said return passage punched in the pump casing, said return passage is crossed to the suction well;

the crossing portion is in communication with the side wall of the suction well; and the bottom surface of the suction well is lower than a bottom surface of said crossing portion.

10. The vane pump of claim 9, wherein said surplus working fluid is returned to said suction well.

11. A vane pump comprising:

a rotor fixed to a pump shaft inserted into a pump casing so as to be rotated;

a multiplicity of vanes within a pump chamber;

wherein said rotor moves said vanes in a radial direction within the pump chamber and pressurizes a working fluid sucked into the pump chamber so as to discharge;

a flow control valve having a return passage with a crossing portion;

a discharge side high pressure passage communicated with the pump chamber;

a suction side low pressure passage communicated with the pump chamber;

said low pressure passage having a flat bottom surface;

wherein said flow control valve returns a surplus of working fluid in the discharge side high pressure passage to the suction side low pressure passage;

said low pressure passage is in communication with said return passage;

the flat bottom surface of said low pressure passage is lower than a bottom surface of said return passage;

said suction side low pressure passage has a suction well;

said suction well is punched in the pump casing and said suction well sucks the working fluid from a reservoir tank via a suction pipe;

said suction well is in communication with said return passage; and said surplus working fluid is returned to said suction well.

12. A vane pump as claimed in claim 11, wherein said suction side low pressure passage has a suction passage connected to said suction well;

a sucking passage communicated with said suction passage;

and a sucking port;

said sucking port in communication with said pump chamber.

13. A vane pump comprising:

a rotor fixed to a pump shaft inserted into a pump casing so as to be rotated;

a multiplicity of vanes within a pump chamber;

wherein said rotor moves said vane in a radial direction within the pump chamber and pressurizes a working fluid sucked into a pump chamber so as to discharge;

a flow control valve having a return passage with a crossing portion;

a discharge side high pressure passage communicated with the pump chamber;

a suction side low pressure passage communicated with the pump chamber;

said low pressure passage having a flat bottom surface;

wherein said flow control valve returns a surplus of working fluid in the discharge side high pressure passage to the suction side low pressure passage;

said low pressure passage is in communication with said return passage;

the flat bottom surface of said low pressure passage lower than is a bottom surface of said return passage; and wherein said return passage is punched in the pump casing.

14. A vane pump comprising:

a rotor fixed to a pump shaft inserted into a pump casing so as to be rotated;

a multiplicity of vanes within a pump chamber;

wherein said rotor moves said vane in a radial direction within the pump chamber and pressurizes a working fluid sucked into a pump chamber so as to discharge;

a flow control valve having a return passage with a crossing portion;

a discharge side high pressure passage communicated with the pump chamber;

a suction side low pressure passage communicated with the pump chamber;

said low pressure passage having a flat bottom surface;

wherein said flow control valve returns a surplus of working fluid in the discharge side high pressure passage to the suction side low pressure passage;

said low pressure passage is in communication with said return passage;

the flat bottom surface of said low pressure passage is lower than is a bottom surfaces said return passage; and wherein said surplus working fluid is unpressurized when it is returned to the suction side low pressure passage.

* * * * *